US006158526A

United States Patent [19]

Ghode et al.

[11] Patent Number: 6,158,526

[45] Date of Patent: Dec. 12, 2000

[54] REVERSIBLE IMPACT MECHANISM WITH STRUCTURE LIMITING HAMMER TRAVEL

[75] Inventors: Anil P. Ghode, Libertyville, Ill.; Paul W. Griffin, Kenosha; Raymond D. DeRome, Twin Lakes, both of Wis.

[73] Assignee: Snap-on Tools Company, Kenosha, Wis.

[21] Appl. No.: 09/265,054

[22] Filed: Mar. 9, 1999

[51] Int. Cl.[7] ..... B25D 15/00

[52] U.S. Cl. ..... 173/93; 173/93.6; 173/109; 173/211

[58] Field of Search ..... 173/93, 93.5, 93.6, 173/178, 205, 203, 211, 117, 109; 81/467

[56] References Cited

U.S. PATENT DOCUMENTS

| | | | |
|---|---|---|---|
| 2,219,865 | 10/1940 | Fitch | 173/93.6 |
| 2,712,254 | 7/1955 | Schodeberg | 173/93.6 |
| 2,753,965 | 7/1956 | Kaman | 173/93.6 |
| 2,907,240 | 10/1959 | Schwenk et al. | 173/93.6 |
| 3,030,839 | 4/1962 | Schadlich | 173/93.6 |
| 3,331,452 | 7/1967 | Wanner | 173/93 |
| 3,610,344 | 10/1971 | Schoeps et al. | 173/93.5 |
| 3,710,873 | 1/1973 | Allen | 173/93.6 |
| 3,741,313 | 6/1973 | States | 173/93.6 |
| 3,804,180 | 4/1974 | Gelfand et al. | 173/93 |
| 3,835,934 | 9/1974 | Schoeps et al. | 173/176 |
| 3,908,768 | 9/1975 | Hess | 173/93 |
| 4,121,670 | 10/1978 | Antipov et al. | 173/1 |
| 4,243,108 | 1/1981 | Galimov et al. | 173/93 |
| 4,313,505 | 2/1982 | Silvera | 173/93.5 |
| 4,811,797 | 3/1989 | Antipov et al. | 173/93 |
| 5,289,885 | 3/1994 | Sakoh | 81/467 |
| 5,544,710 | 8/1996 | Groshans et al. | 173/93.5 |
| 5,601,149 | 2/1997 | Kawasaki et al. | 173/93.5 |
| 5,706,902 | 1/1998 | Eisenhardt | 173/93.5 |
| 5,836,403 | 11/1998 | Putney et al. | 173/93.5 |
| 5,992,538 | 11/1999 | Marcengill et al. | 173/93 |

*Primary Examiner*—Peter Vo
*Assistant Examiner*—Jim Calve
*Attorney, Agent, or Firm*—Seyfarth Shaw

[57] ABSTRACT

An impact mechanism, such as an impact wrench is provided and includes a motor, a shaft rotatable about an axis and coupled to the motor and having a first shaft groove with first and second axial ends and a hammer disposed about the shaft and having a first hammer groove. A ball is disposed in the first hammer groove and in the first shaft groove and couples the hammer to the shaft for relative axial and rotatable movement, with the ball moveable along the grooves. The wrench also includes a rotatable anvil for coupling to a load, a bias member resiliently biasing the hammer axially into engagement with the anvil and stop structure disposed along the shaft for engagement with the hammer to limit axial movement of the hammer away from the anvil so as to prevent the ball from contacting the second axial end of the first shaft groove.

8 Claims, 8 Drawing Sheets

REVERSIBLE IMPACT MECHANISM WITH STRUCTURE LIMITING HAMMER TRAVEL

BACKGROUND OF THE INVENTION

1. Field of the Invention

The present invention relates to power hand tools, in particular to impact tools, such as impact wrenches.

2. Description of the Prior Art

Impact wrenches for applying intermittent torque impulses to tighten or loosen a fastener are well known. These prior mechanisms include a rotatable drive shaft connected to a motor, a hammer disposed about and coupled to the shaft, and an anvil engageable with a load, either directly or by means of a coupling tool, such as a socket. The anvil has a pair of ears engageable with corresponding ears on the hammer. These impact mechanisms also include a spring for biasing the hammer toward the anvil to engage the hammer ears with the anvil ears and a cam mechanism to allow the hammer to rotate with respect to the shaft and to move axially along the shaft away from the anvil when resistance torque builds up at the workpiece. In a reversible impact wrench, the cam mechanism commonly includes a pair of V-shaped cam ramps or grooves on the exterior of the drive shaft and a corresponding pair of cam ramps or grooves on the interior surface of the hammer and two balls respectively disposed in the grooves. Each leg of each V-shaped groove defines a portion of a helix. When the drive shaft rotates clockwise and enough resistance torque is built up, the cam mechanism causes the hammer to move axially away from the anvil as the balls travel along one respective leg of the V of each groove. When the shaft rotates counterclockwise, the ball travels along the other respective leg of the V of each groove as the hammer retracts axially. Depending on the torque build up, the hammer can retract axially a great enough distance such that the ball bottoms out at the end of the groove of the drive shaft. This can cause the end surfaces of the grooves and the balls to be worn and roughened, making it more difficult for the motor to rotate the shaft, and may require the replacement of either the balls or shaft.

SUMMARY OF THE INVENTION

It is a general object of the invention to provide an improved impact mechanism which avoids the disadvantages of prior impact mechanisms while affording additional structural and operating advantages.

An important feature of the invention is the provision of a reversible impact mechanism which is of relatively simple and economical construction.

Another feature of the invention is the provision of an impact mechanism of the type set forth, which can provide high torque impulses to a load without damage to the shaft or the balls of the impact mechanism.

A further feature of the invention is the provision of an impact mechanism of the type set forth, which does not cause undue stress to a motor after extended use.

Certain ones of these and other features of the invention may be attained by providing an impact mechanism including a motor, a shaft rotatable about an axis and coupled to the motor and having a first shaft groove with first and second axial ends, and a hammer disposed about the shaft and having a first hammer groove. A ball, disposed in the first hammer groove and in the first shaft groove couples the hammer to the shaft for relative axial and rotatable movement with the ball moveable along the grooves. The mechanism also includes a rotatable anvil for coupling to a load, a bias member resiliently biasing the hammer axially into engagement with the anvil and stop structure disposed along the shaft for engagement with the hammer to limit axial movement of the hammer away from the anvil so as to prevent the ball from contacting the second axial end of the first shaft groove.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figures 1, 2:
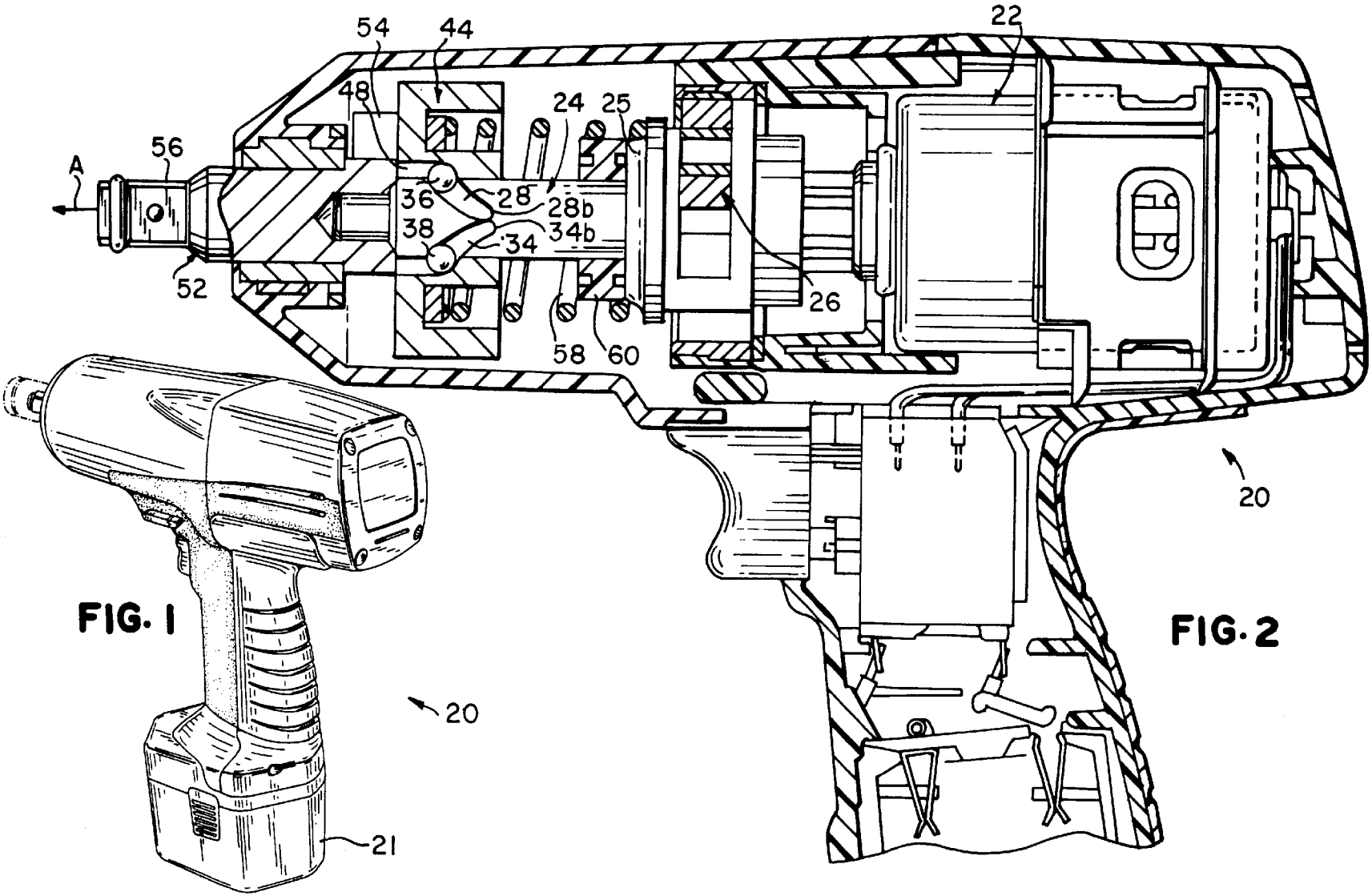
FIG. 1 is a perspective view of the impact mechanism of the present invention.
FIG. 2 is an enlarged fragmentary, vertical sectional view of the mechanism of FIG. 1, illustrating the hammer engaged with the anvil in a normal rest condition.

Referring to FIGS. 1 and 2, an impact mechanism, in the form of an impact wrench 20 is illustrated. As seen in FIG. 2, the impact wrench 20 includes an electric motor 22 powered by a battery 21. The motor 22 is coupled to a shaft 24 having a base portion 25. The shaft 24 is coupled to the motor 22 by a gearing structure 26, in a known manner. The motor rotates the shaft 24 about an axis A.

Figure 3:
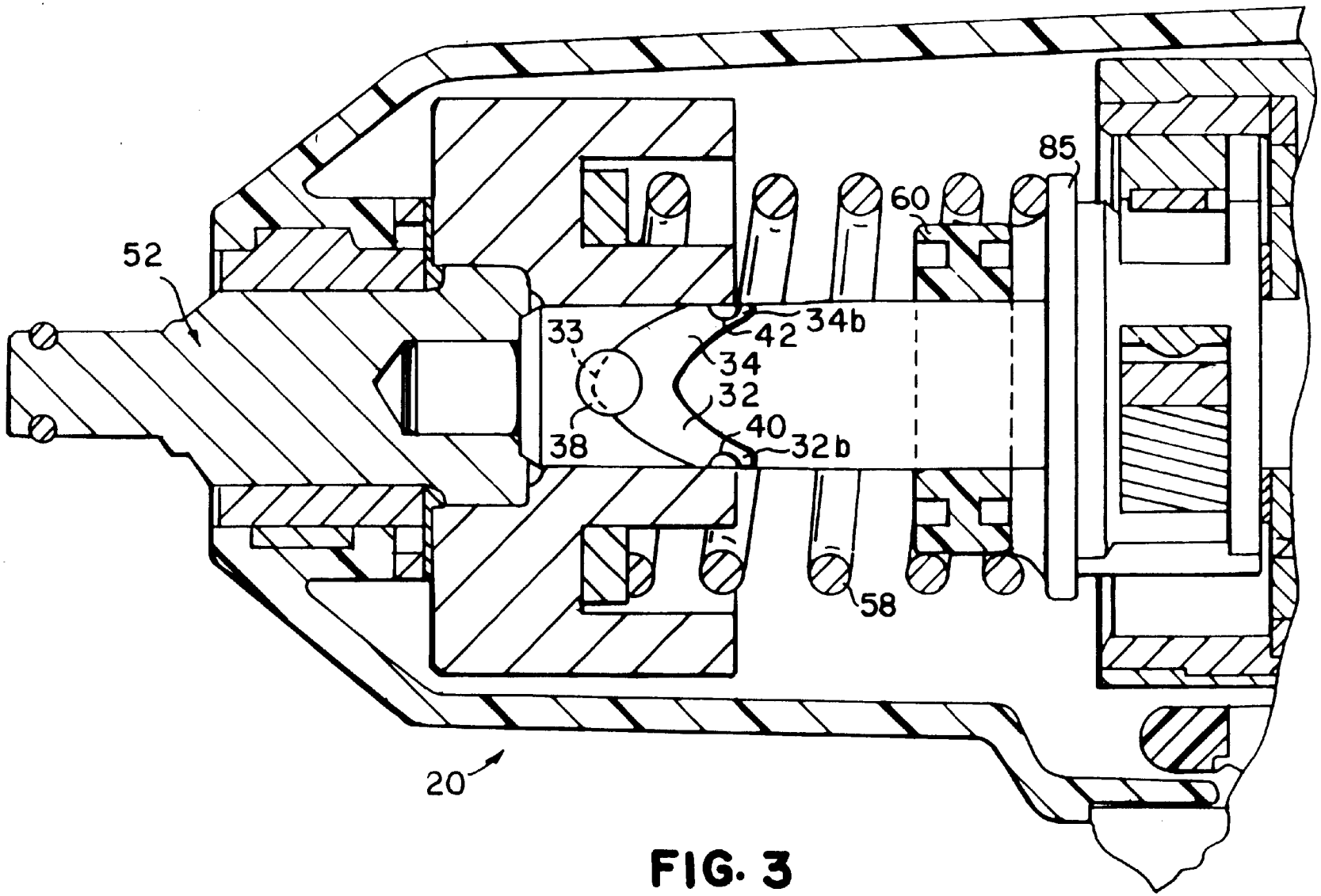
FIG. 3 is a further enlarged, fragmentary, sectional view illustrating the shaft rotated 90 degrees from the position of FIG. 2.

Referring to FIGS. 2–6, the shaft 24 includes four helical grooves 28, 30, 32 and 34. Grooves 28 and 30 are opposite part-helixes and intersect to generally define a "V" at a common first axial end 31 (FIG. 4) away from the motor 22. A ball 36, discussed further below, is disposed and moveable in grooves 28 and 30 and, at rest, is disposed at the end 31 at the apex of the "V". Similarly, grooves 32 and 34 are opposite part-helixes and intersect to generally define a "V" at a common and first axial end 33 (FIG. 3). The axial ends 31 and 33 are spaced apart 180 degrees. A ball 38 is disposed and moveable in grooves 32 and 34. As seen in FIGS. 3–6, grooves 28, 30, 32 and 34, respectively also have second axial ends 28*b*, 30*b*, 32*b* and 34*b* disposed closer to the motor 22 than the first axial ends 31, 33. The second axial ends 28*b*, 30*b*, 32*b* and 34*b* are disposed at the same axial location along the shaft 24. As seen in FIGS. 3–6, a small thin wall 40 is formed between and separates grooves 30 and 32 at their second axial ends 30*b* and 32*b*. Similarly, a small thin wall 42 is formed between and separates grooves 28 and 34 at their second axial ends 28*b*, 34*b*. Walls 40 and 42 respectively aid in retaining ball 36 in grooves 28 and 30 and ball 38 in grooves 32 and 34.

Figure 10:
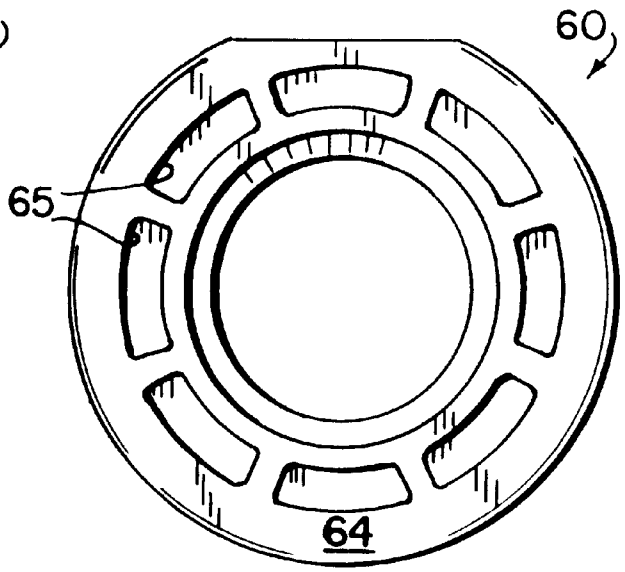
FIG. 10 is a bottom plan view of the impact spacer FIG. 8.
Figure 9:
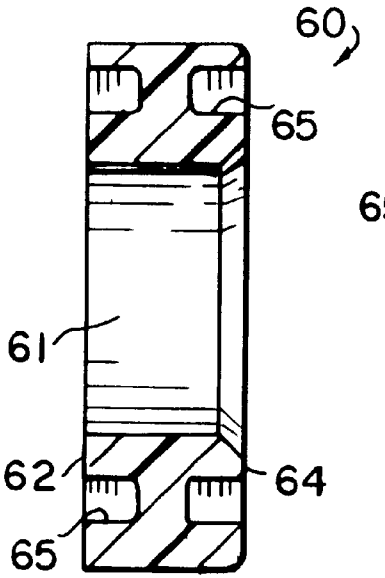
FIG. 9 is a sectional view taken generally along the line 9—9 of FIG. 8.
Figure 8:
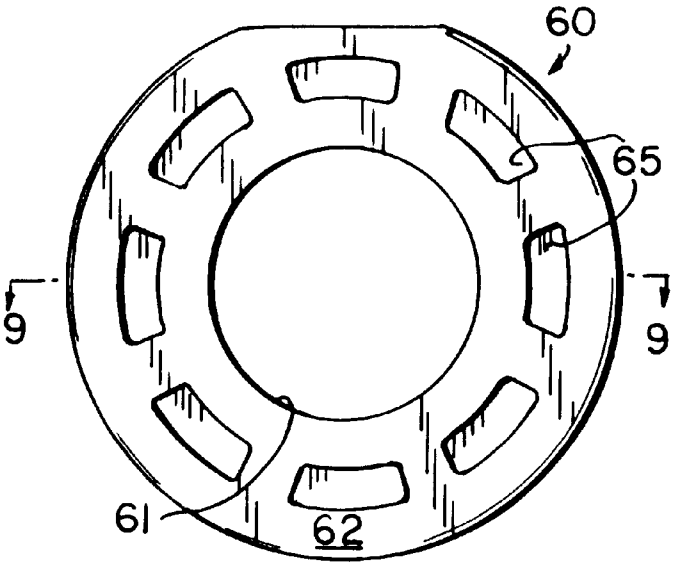
FIG. 8 is a top plan view of the impact spacer.
Figure 11:
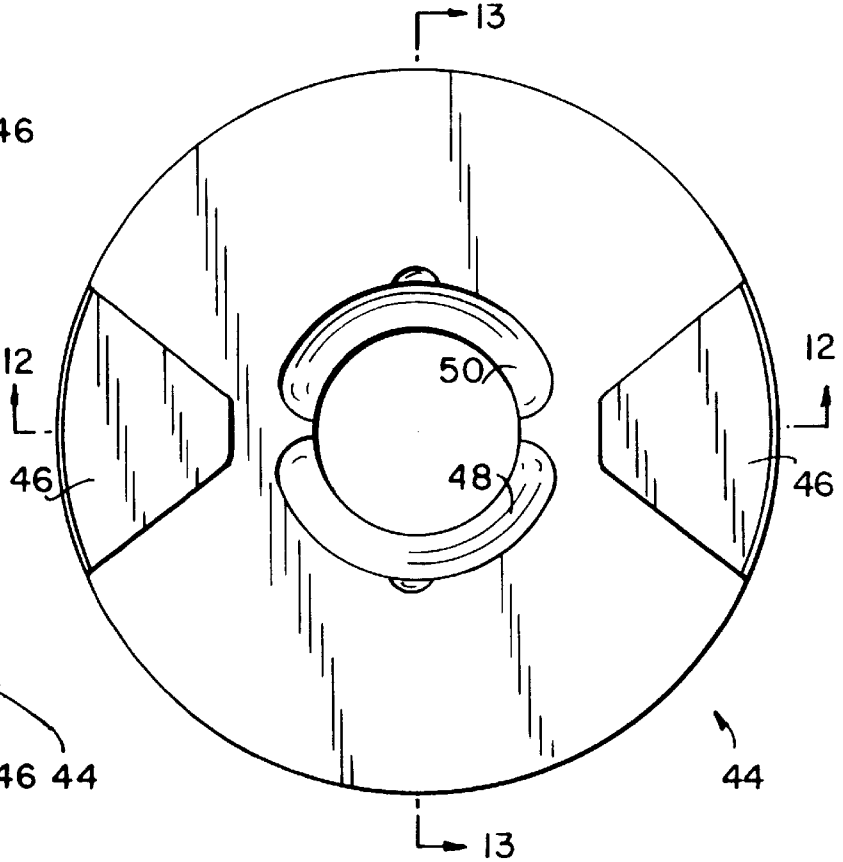
FIG. 11 is a top plan view of the hammer of the present invention.
Figure 12:
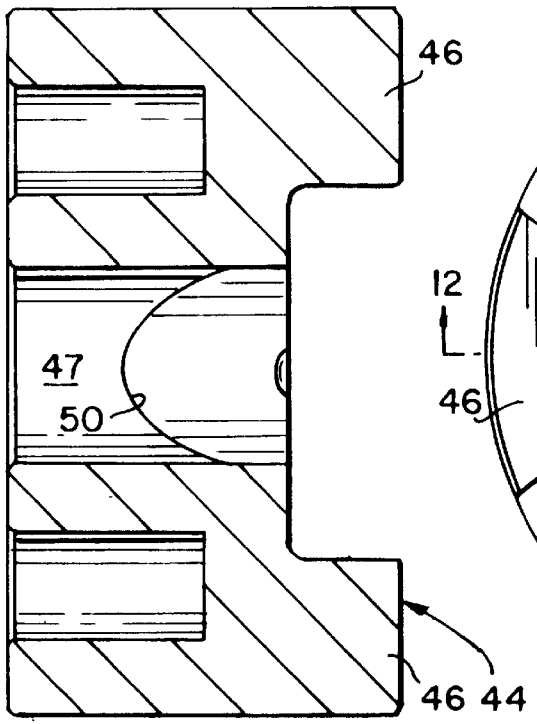
FIG. 12 is a sectional view taken generally along the line 12—12 of FIG. 11.
Figure 13:
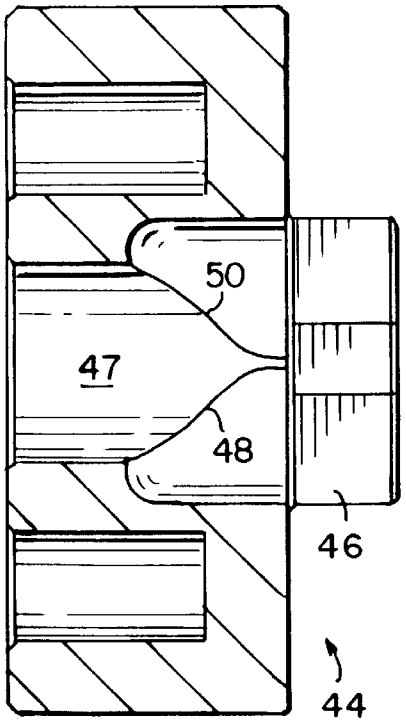
FIG. 13 is a sectional view taken generally along the line 13—13 of FIG. 11.

As seen in FIGS. 10–12, the impact wrench 20 also includes a cylindrical hammer 44 having two ears 46, an inner cylindrical surface 47 and two diametrically opposed, generally V-shaped grooves or cam surfaces 48, 50 formed in the inner surface 47. As seen in FIGS. 2–6, the hammer 44 is disposed coaxially about the shaft 24.

The impact wrench 20 also includes an anvil 52 having a pair of ears 54 (best seen in FIGS. 5–6) engageable by the ears 46 of the hammer 44 to rotate the anvil 52, in a known manner. The anvil 52 also includes a square 56 for coupling to a load, typically via a coupling tool, such as a socket (shown in phantom in FIG. 1).

The impact wrench 20 further includes a coil spring 58 disposed about the shaft 24, with one end seated against the base portion 25 of the shaft 24 and the other end seated in an annular groove in the rear face of the hammer 44. The spring 58 biases the hammer 44 axially towards the anvil 52 to engage the hammer ears 46 with the anvil ears 54.

The impact wrench 20 also includes an impact spacer 60 disposed within the coils of the spring 58 about the shaft 24 adjacent to the base portion 25. The impact spacer 60 is a discrete member formed of a material that is able to absorb shock. The impact spacer 60 may be formed of a hard plastic such as a hard nylon. The spacer 60 is cylindrical and has a cylindrical aperture 61 through which the shaft 24 is disposed. Spacer 60 is preferably attached to the shaft 24 by press fitting, or the like, so that it is immoveable with respect to the shaft 24. The spacer 60 has a front surface 62 and a rear surface 64 with circumferentially spaced recesses 65 formed in each of the surfaces 62 and 64.

Depending upon the direction of rotation of the shaft 24, ball 36 is disposed in either groove 28 or groove 30 of the shaft 24 and one or the other leg of the V-shaped groove 48 of the hammer 44, and ball 38 is disposed in either groove 32 or 34 of the shaft 24 and in and one or the other leg of the V-shaped groove 50 of the hammer 44. In this manner, hammer 44 is coupled to the shaft 24 and is able to move axially and rotatably relative to the shaft 24. Balls 36, 38 are respectively moveable along the grooves 28, 30, 32, 34 to cause the hammer 44 to move axially, all in a known manner.

Figure 4:
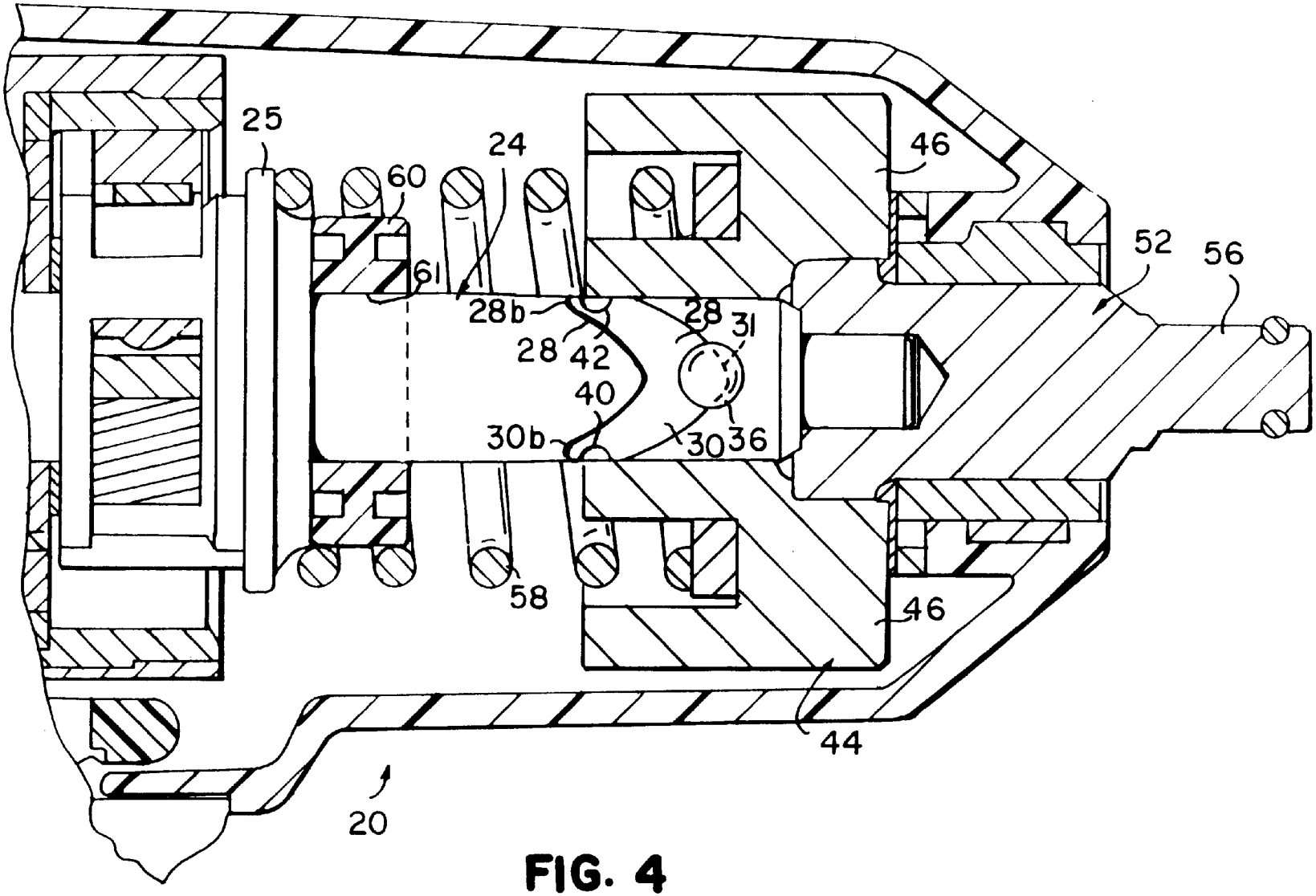
FIG. 4 is a sectional view taken along the same plane as that of FIG. 3, but viewed in the opposite direction.
Figure 5:
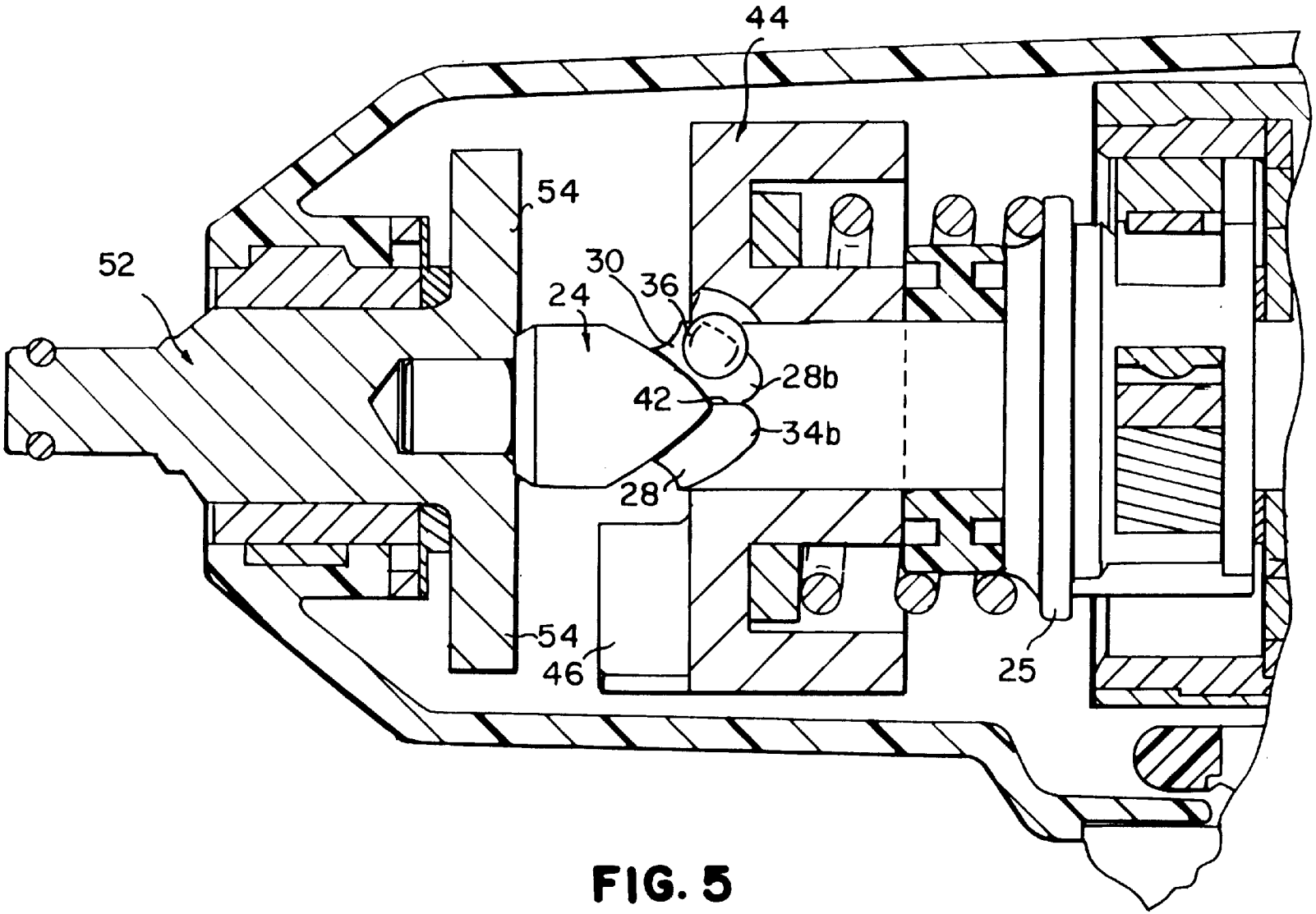
FIG. 5 is a sectional view similar to FIG. 3, the mechanism with the hammer retracted the greatest permissible axial distance away from the anvil.
Figure 6:
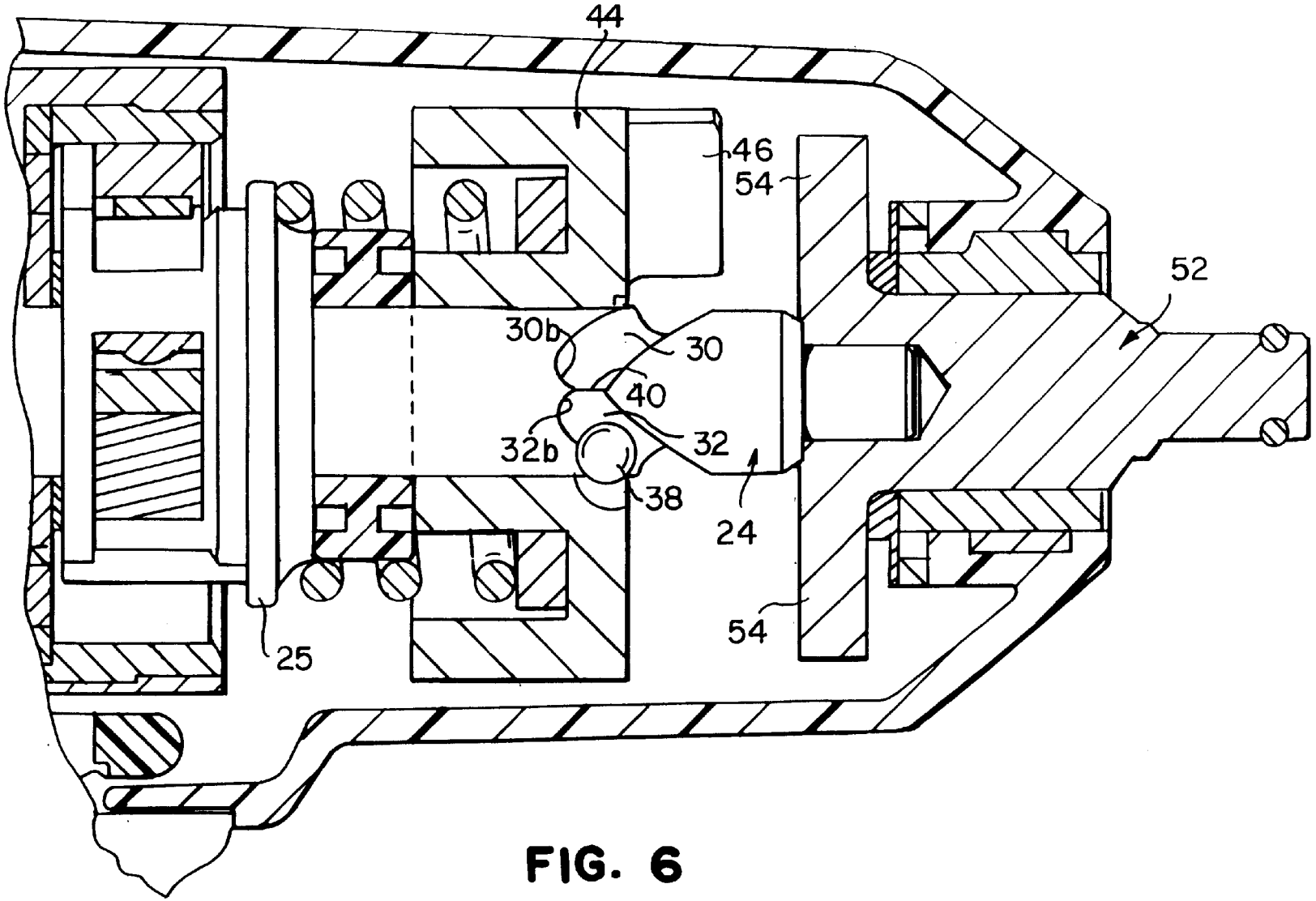
FIG. 6 is a sectional view taken along the same plane as that of FIG. 5, but viewed in the opposite direction.
Figure 7:
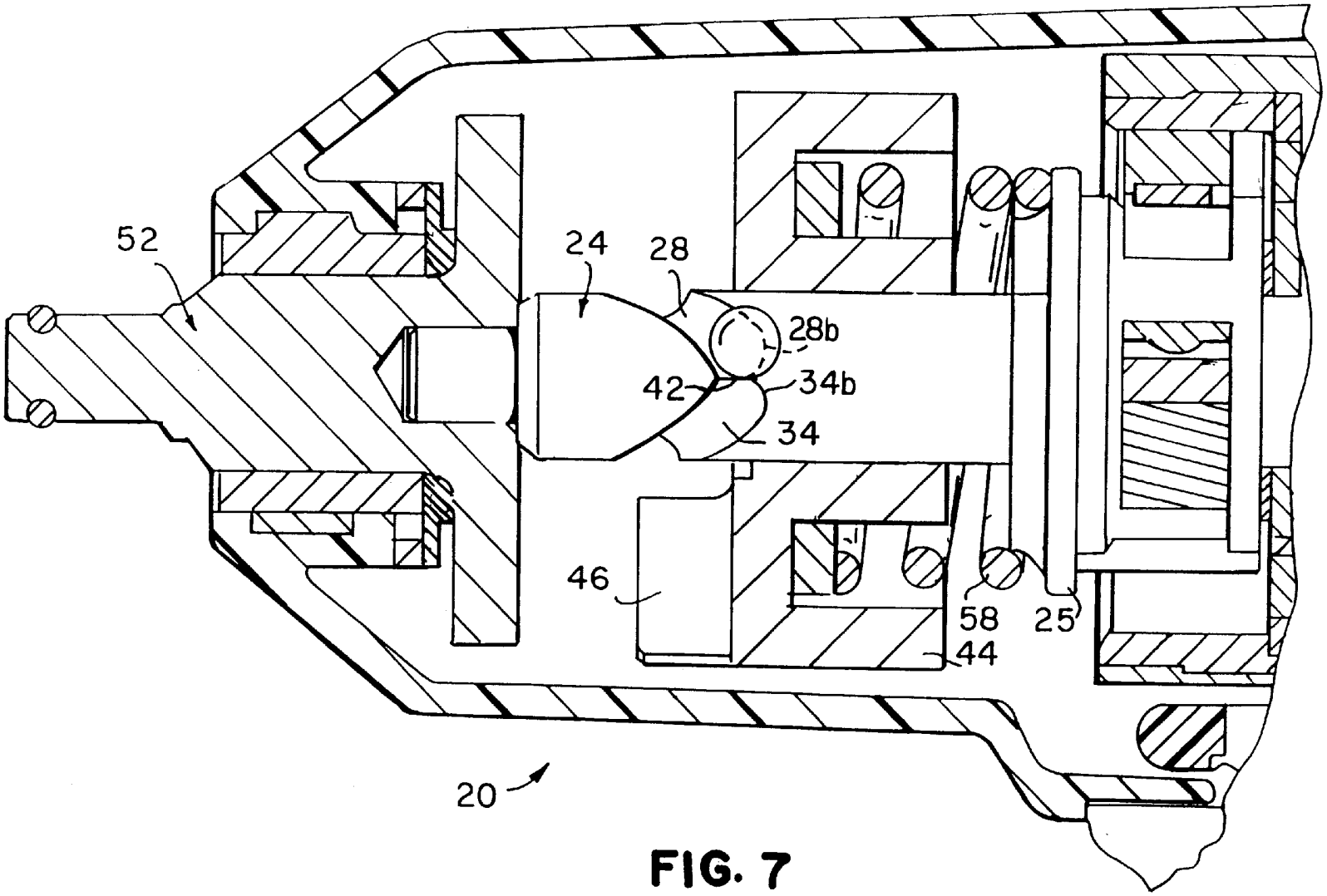
FIG. 7 (PRIOR ART)
FIG. 7 is a sectional view similar to FIG. 5, illustrating the prior art impact mechanism without the impact spacer of the present invention.

As discussed above, the spring 58 biases the hammer 44 into engagement with the anvil 52. As seen in FIGS. 2–4, when the hammer 44 is so engaged, balls 36 and 38 are respectively disposed in the first axial ends 31 and 33 of grooves 28–34. When the square 56 is coupled to a load, such as a fastener joint, and resistance torque builds up in the fastener joint, the hammer 44 is forced axially away from the anvil 52 toward the motor 22. As seen in FIGS. 5 and 6, if enough resistance torque has built up, the hammer 44 will be sent axially back, or rebound, until it contacts the upper surface 62 of the impact spacer 60 prior to the balls 36 or 38 bottoming out in the second axial ends 28*b*, 30*b*, 32*b*, 34*b* of the grooves 28, 30, 32, 34. The spacer 60 thus limits the axial movement of the hammer 44 and prevents the balls 36 or 38 from bottoming out in any of the second axial ends of 28*b*–34*b* and causing damage to walls 40 or 42, grooves 28–34 or to the balls 36, 38, themselves. As seen in FIG. 7, without the spacer 60 disposed about the shaft 24, the balls 36 and ball 38 (not shown) will bottom out and could cause damage to the wall 42 and wall 40 (not shown) which limit the ball (36 or 38) and hammer 44 movement axially away from the anvil 52.

The spacer 60 is advantageously formed of a material, discussed above, which provides shock absorption. The hammer 44 may rebound axially from its impact with the anvil 52 and strike the impact spacer 60 with a heavy blow. The impact spacer 60 cushions the blow causing less jarring to a user. Additionally, since the hammer 44 is normally made of a metal and the impact spacer 60 is formed of a hard plastic, the impact spacer 60 will not harm the hammer 44 when contacted with such a heavy blow, thereby prolonging the life of the hammer 44.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An impact mechanism comprising:

a motor;

a shaft rotatable about an axis and coupled to the motor and having a first shaft groove with first and second axial ends;

a hammer disposed about the shaft and having a first hammer groove;

a ball disposed in the first hammer groove and in the first shaft groove and coupling the hammer to the shaft for relative axial and rotatable movement with the ball moveable along the grooves;

a rotatable anvil for coupling to a load;

a bias member resiliently biasing the hammer axially into engagement with the anvil; and stop structure formed of a plastic material and coupled to the shaft for engagement with the hammer to limit axial movement of the hammer away from the anvil so as to prevent the ball from contacting the second axial end of the first shaft groove, wherein the bias member is a coil spring and the spacer is totally disposed within the coils of the spring, and wherein the spacer has a front surface with a plurality of circumferentially spaced recesses formed therein.

2. The impact mechanism of claim 1, wherein the stop structure is a generally cylindrical spacer disposed about the shaft.

3. The impact mechanism of claim 2, wherein the spacer is formed of a hard nylon.

4. The impact mechanism of claim 2, wherein the spacer is discrete from the shaft.

5. The impact mechanism of claim 2, wherein the spacer is press fitted onto the shaft.

6. The impact mechanism of claim 1, wherein the first shaft groove and first hammer groove are helical.

7. The impact mechanism of claim 1, wherein the shaft includes a second shaft groove with first and second axial ends, and the hammer includes a second hammer groove, and further including a second ball disposed in and moveable along the second hammer groove and the second shaft groove, wherein when the hammer engages the stop structure the second ball is prevented from contacting the second axial end of the second shaft groove.

8. The impact mechanism of claim 1, wherein the motor is an electric motor.

* * * * *